United States Patent [19]

Fresard

[11] Patent Number: 4,592,296

[45] Date of Patent: Jun. 3, 1986

[54] SEWING HEAD

[75] Inventor: Marcel Fresard, Geneva, Switzerland

[73] Assignee: Mefina S.A., Fribourg, Switzerland

[21] Appl. No.: 521,758

[22] PCT Filed: Feb. 22, 1983

[86] PCT No.: PCT/CH83/00019

§ 371 Date: Aug. 2, 1983

§ 102(e) Date: Aug. 2, 1983

[87] PCT Pub. No.: WO83/02967

PCT Pub. Date: Sep. 1, 1983

[30] Foreign Application Priority Data

Feb. 22, 1982 [CH] Switzerland ..... 1076/82

[51] Int. Cl.[4] ..... D05C 3/04; D05C 7/04; D05B 55/16

[52] U.S. Cl. ..... 112/83; 112/89; 112/221; 112/98

[58] Field of Search ..... 112/83, 84, 85, 89, 112/98, 221

[56] References Cited

U.S. PATENT DOCUMENTS 3,118,403 1/1964 Chambers ..... 112/221 X

FOREIGN PATENT DOCUMENTS 0040333 11/1981 European Pat. Off. ..... 112/83
2704855 8/1978 Fed. Rep. of Germany ..... 112/83
2825802 12/1979 Fed. Rep. of Germany ..... 112/221
2900804 7/1980 Fed. Rep. of Germany ..... 112/221

*Primary Examiner*—H. Hampton Hunter
*Attorney, Agent, or Firm*—Groff & O'Brien

[57] ABSTRACT

The sewing head comprises at least a cylindrical sector (2) mounted to rotate in a cradle (1) and exhibiting tubular housings inside each of which a tool holder bar (3) is guided.

The tools of this sewing head can be coupled to the mechanism of an ordinary embroidery machine. It makes possible a simplification of the handlings required during the changing of embroidery patterns to be made and for the replacement of damaged tools.

9 Claims, 8 Drawing Figures

SEWING HEAD

The invention has as its object a sewing head to be mounted on an embroidery machine comprising a plurality of tool holder bars, arranged in parallel relation to one another and adapted for selective reciprocal movement into an operative position.

Embroidery machines comprising needles and punches, fixed to mobile supports, operated by a separate mechanism that provides reciprical movement of the needles and punches in an axial direction are well known.

Each machine is provided, along its entire length, with a row of needles placed side by side. The distance between two adjacent needles is 1 French inch, or 27.07 mm. When the embroidery comprises a row of two needles only, the distance between needles is defined, in the trade jargon as 4/4. For a three needle machine, the distance between 3 needles placed side by side will be 8/4, for a four needle machine the distance between 4 needles will be 12/4 etc. Thus, an embroidery machine can be identified by the number of needles on the machine and its needle pattern. These machines operate at an average speed of 200 stitches per minute.

During embroidery, the productivity is reduced substantially in a ratio directly proportional to the various different characteristics of the threads: eg. quality, thickness and color. Poor quality will require extensive rethreading; thickness affects needle breakage and speed of the machine; whereas color requires a plurality of changes. All of these characteristics affect the performance of the embroidery machine. In actual practice on traditional machines, after the embroidery with the first thread having certain characteristics, the embroidery machine has to be stopped to unthread all of the needles used and to rethread them with the new thread that may have different characteristics. This operation is very tedious and time consuming. It has to be repeated for each thread changing, thus greatly decreasing productivity. When changing the pattern, it is necessary to replace needles as a function of the pattern and to remove needles which have become worn or broken.

In that embroidering operation where holes have to be punched in precise places of the fabric, punches are mounted an appropriate supports for simultaneous movement with the needles. During the changing of a pattern, it may also be necessary to replace the punches on their support as a function of a new pattern, which replacement also requires prolonged stops of the machine.

To increase productivity, some machines have been equipped with a second row of needles located parallel to the first row of needles.

It should be recognized that existing machines can have from 340 to more than 700 needles per depending on the size of the machine.

Attempts to overcome the problem inherent in the very complex design of these embroidery machines have failed to provide the desired result eg: ease of operation, reduced maintenance and increased productivity. Changes in design of new machines as well as modifications to existing machines have been difficult because of the extensive modifications required. Designs for improving new machines and modifying existing machines have resulted in devices which are too bulky or require excessive forces to operate whereby the power required to operate the machine would have to be increased significantly, since the various parts must, in many cases, be driven against the action of return springs.

The sewing head which, according to this invention makes it possible to reduce the down time of the machine, is characterized by several needle holder bars that are located in a cylindrical sector mounted to rotate in a cradle and which comprises a driver for reciprocally moving a needle holder bar in a direction along its longitudinal axis, so as to be engaged or disengaged to the operating mechanism of an embroidery machine and a device for selecting a certain needle holder bar to be coupled with the driver.

The accompanying drawing diagrammatically shows, by way of example, an embodiment of the sewing head according to the invention.

Figure 5:
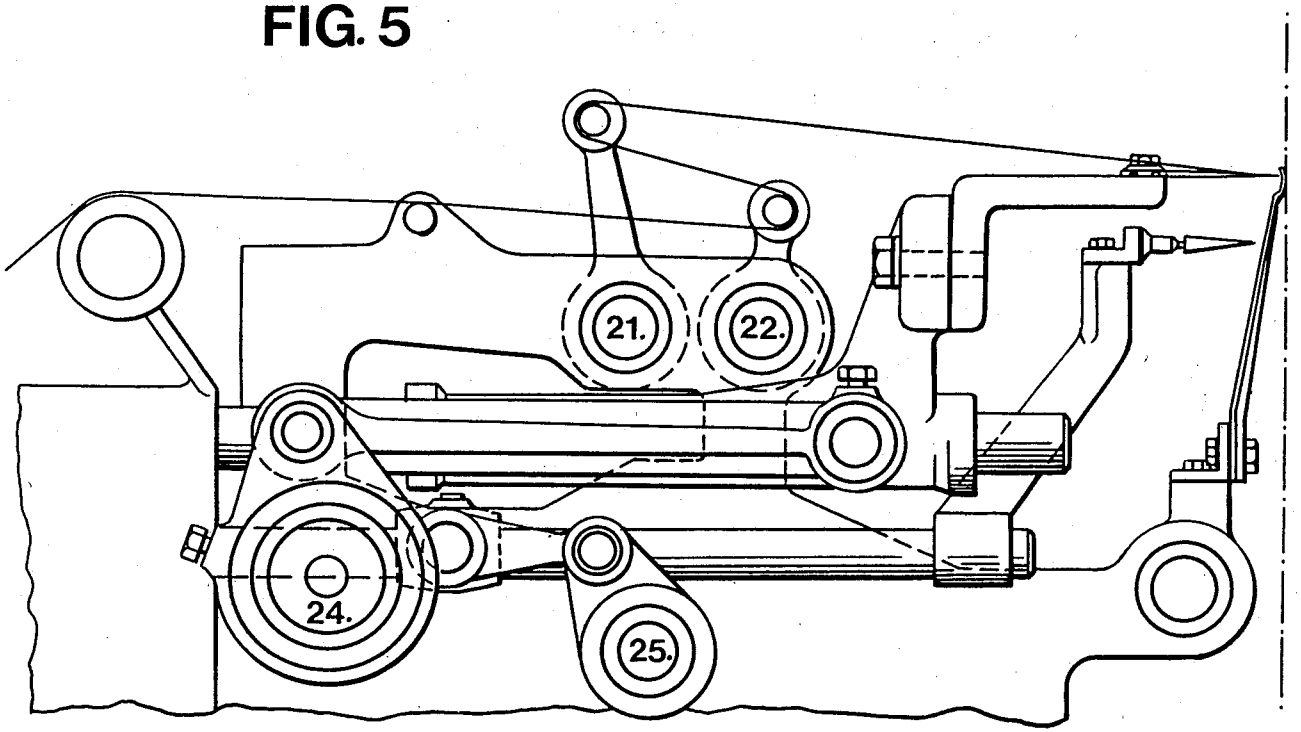
FIG. 5 is a partial view of an embroidery machine of the prior art, showing a needle and a punch mounted on its mechanism for comparison.
Figure 6:
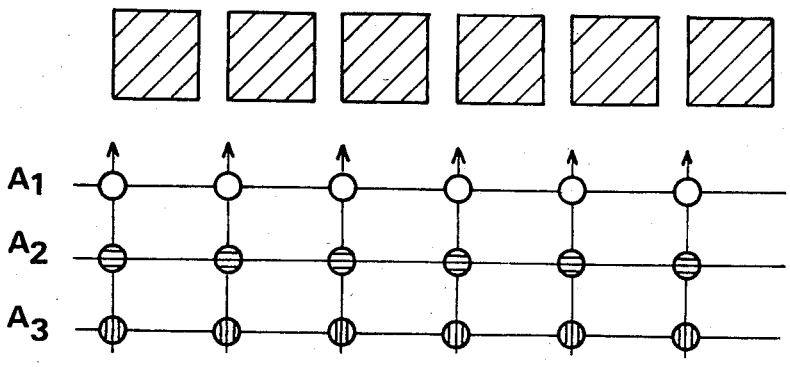

FIG. 6 diagrammatically shows the sequence of operations required for embroidery with three different threads on a machine such as the one shown in FIG. 5.

Figure 7:
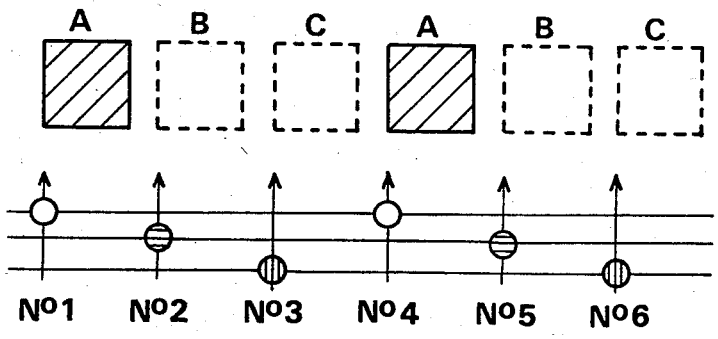

FIG. 7 diagrammatically shows the sequence of operations required for embroidery with three different threads on another machine of the prior art.

Figure 4:
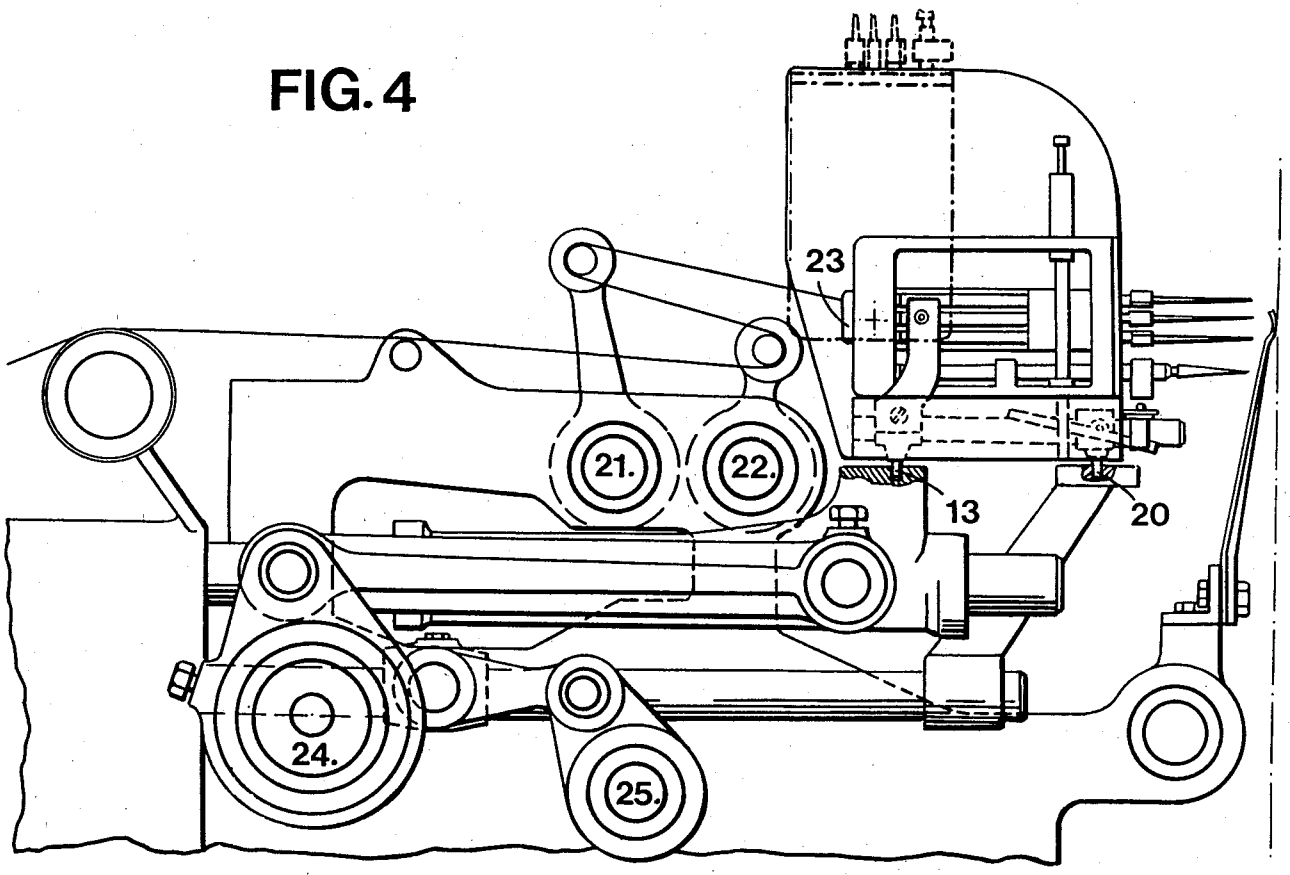
FIG. 4 is a view of it similar to FIG. 1 showing the sewing head, coupled to the mechanism of an embroidery machine of the prior art.
Figure 8:
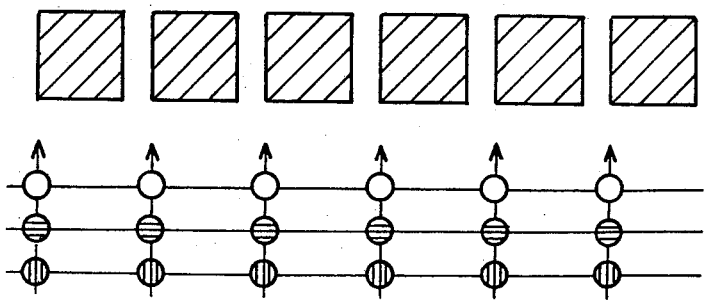

FIG. 8 diagrammatically shows the sequence of operations required for embroidery with three different threads on the machine shown in FIG. 4.

Figure 1:
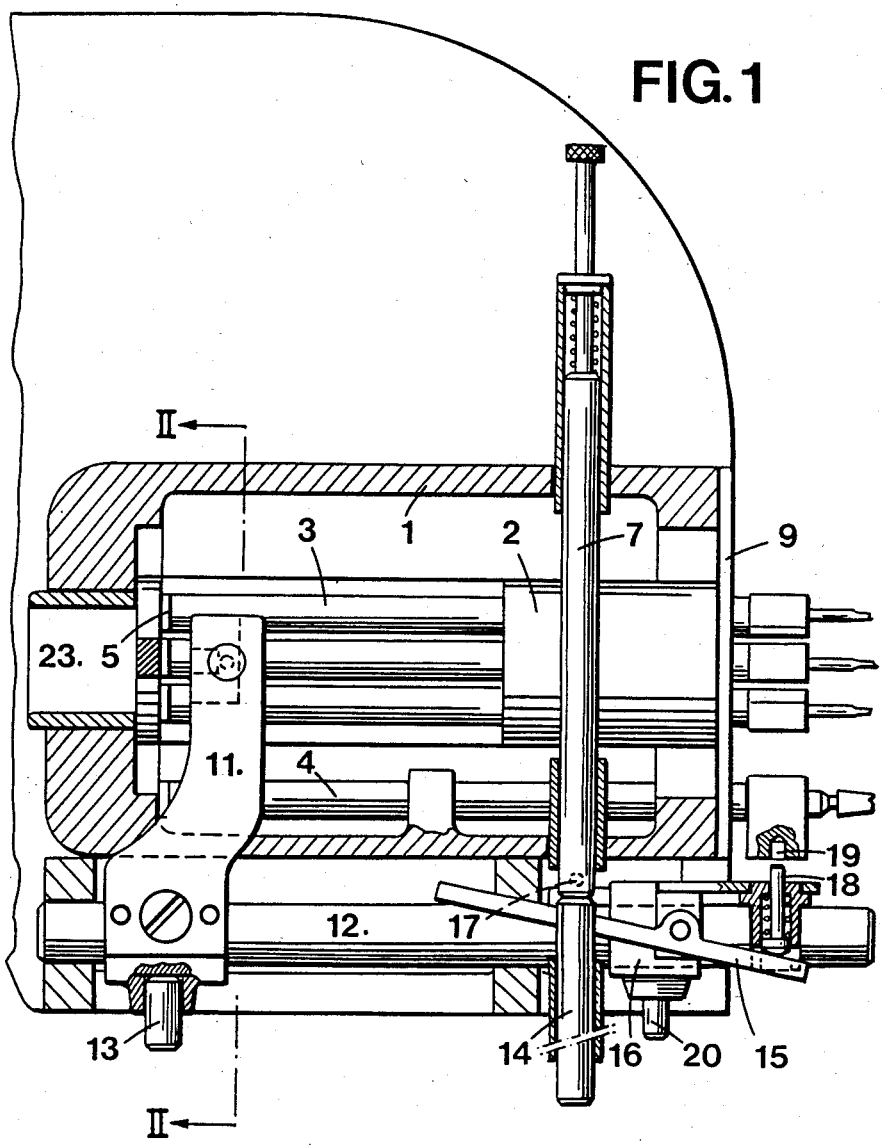
FIG. 1 is a partial elevation view of it in axial section.
Figure 2:
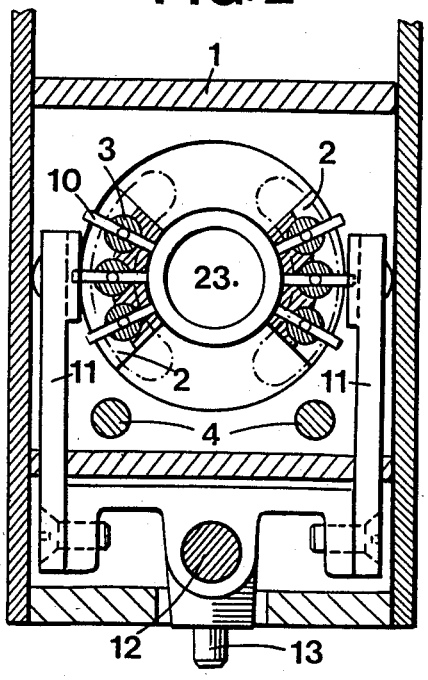
FIG. 2 is a cross section view of it along II—II of FIG. 1.

As shown in FIGS. 1 and 2, the sewing head comprises a cradle 1 in which two cylindrical sectors 2 for guiding needle holder bars 3 are mounted to rotate around a cylindrical support 23. Each of these cylindrical sectors has three tubular housings inside each of which a needle holder bar 3 is slidably located to move in an axial direction.

Two punch holder bars 4 are individually and slidably mounted to the cradle 1 for movement in a direction parallel to the needle holder bars 3. In their retracted inactive positions, bars 3 and 4 are held in the cradle 1 by magnets 5. Each of the cylindrical sectors 2 have on their periphery teeth 6 which mesh with rectilinear teeth of a pushrod 7 intended to move 7 the cylindrical sector 2 in rotation within specific limits. Curved notches 8 are cut into a plate 9 that closes the forward end of the cradle 1. These semicircular notches 8 provide a passage to the forward end of the needle holder bars 3.

Figure 3:
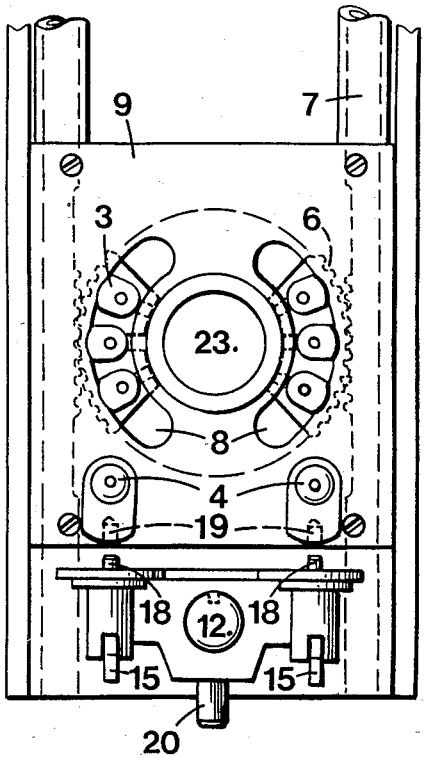
FIG. 3 is an end view of it from right to left of FIG. 1.

The needle holder bars are each provided with pins 10 for engaging a drive arm 11 mounted to slide on a guide bar 12 associated with the cradle 1. The drive arm 11 is itself provided with a stud 13 for coupling it to the driving mechanism of an embroidery machine. The end of the pins 10 opposite that which engages drive arm 11 is located in a longitudinal groove of the cylindrical sector 2 to guide the needle holder bars 3 in an axial direction. As shown in FIGS. 1 and 3, slide 16 is secured to bar 12 for movement therewith and carries at each opposite end, a pivotally mounted lever 15. Each push rod 7 carries a pin that is mounted to engage its respective lever 15 when depressed. When engaged by pin 17, lever 15 moves pin 18 into housing 19 of punch holder bar 4, whereby holder bar 4 is coupled for movement with bar 12. Stud 20, carried by slide 16, couples the drive mechanism of the embroidery machine to bar 12 for movement in timed sequence with a selected needle bar holder 3. While not shown, it is possible to mount punch holder bar 4 on needle holder bar 3 for movement therewith.

In FIG. 4 there is shown the sewing head mounted, with minor changes, on an ordinary embroidery machine such as the one shown in FIG. 5. That portion of the machine located above the line through the center of pivots 21 and 22 and located between pivot 22 and the needles is removed. The new sewing head of this invention is mounted to the mechanism for moving the needle holder bars 3 and punch holder bars 4 by their respective studs 13 and 20, as shown in FIG. 4.

The embroidery machines of the prior art are designed so as to provide a constant distance of a French inch (27.07 mm) between the adjacent needles. This same distance is to be maintained in the sewing head according to the present invention and this is possible by incorporating two groups of three needles with each group located within cylindrical support 23, and each provided with its own thread. The needles of each of these groups of three needles can be substituted for one another or disengaged by rotation of their cylindrical sector 2 under the action of their respective selection element 7.

By activating their respective lever 15, either or both punches can be engaged.

In the embodiment shown in FIG. 4, the needle holder bars are driven by a connecting rod from an oscillating shaft 24 that stretches along the entire length of the embroidery machine. It is the same with the punch holder bars, which are driven by an oscillating shaft 25. However, they can be driven by any other pneumatic or electronic mechanical means.

A number of the sewing heads of this invention can be positioned side by side, mounted to pivot about a crosswise axis so as to be movable from an operative to an inoperative position. In FIG. 4, there is shown, in phantom line, one sewing head in the inoperative position. It is thus possible to easily disengage several individual sewing heads particularly when a change of thread or needle is required.

Preferably, the crosswise shaft for pivoting the cradle 1 is at the top of the cylindrical support 23 so that when the cradle is pivoted from its operative position, to its inoperative position, the length of the threads between the eye of the needles and the thread puller remains unchanged.

It should be further noted that, by moving push rods 7 to their uppermost position, as shown in FIG. 1, pin 10 of each of the lowermost needle holder bars 3 is disconnected from its drive arm 11 at the end of the stroke, which makes it possible to disengage it.

Conversely, fully depressing pushrod 7 rotates the lever 15 about pin 17 and couples the punch holer 4 to its drive slide 16.

When two pins 10 are simultaneously out of contact with their drive bar 11, the latter drives the corresponding tool holder bars 3 into contact with magnets 5 where they remain disengaged because the shape of the element carried by the arm 11 for moving bars 3 from left to right in FIG. 1 assures the drive of a pin 10 only in a centered position of the latter.

By comparison, FIGS. 6 and 7, show the operations required to make embroidery patterns with three threads of different colors on machines of the prior art and in FIG. 8 the operation required to make the same patterns on a machine fitted with the sewing head according to the invention.

As shown in FIG. 6, to make embroidery patterns on a traditional machine, with 3 threads of different colors superposed or juxtaposed within the pattern, there has to be, in a first embroidery operation A1 using the first color, all the stitches that will appear in this pattern; then the machine is stopped and the threads are replaced with those of second color. The machine is then restarted to embroider in a second operation A2 with the second color. Said operations are repeated in A3 to embroider the stitches of the third color.

As shown in FIG. 7, these multiple stops can be eliminated by threading the juxtaposed needles with various threads in a specific sequence, these needles being engaged successively, to embroider into a pattern the stitches of different colors one after the other.

The pattern is embroidered in one color in a first operation with needle No. 1. The stitches made with the second color will be made in a second operation with needle No. 2. The stitches embroidered with the following color will be made in a third operation using needle No. 3. Looking at this figure, it clearly appears that, for a pattern, 3 juxtaposed needles (1, 2, 3) are used.

The next pattern will be embroidered with the next three needles (4, 5, 6) which causes a one third reduction is productivity. Actually, when the first patterns are made in phase A, there must be, between them, the free space of 2 patterns which have to be embroidered after cutting, one after the other, in phases B and C, to use the full surface of the fabric. Between each phase, the fabric must be moved laterally by the value of pattern, i.e., the complete fabric can only be embroidered in 3 phases that each represent 3 operations.

As shown in FIG. 8, this invention makes it possible to meet, simply and efficiently, the desired goal, i.e., to increase the productivity of the machines while being able to be applied to both the manufacture of new machines and the changeover of the existing stock of machines.

It is found that at each position of needles, there is the possibility of using 3 different threads and the passage of one thread to the other can be done, by appropriate control means, without stopping the machine and the embroidered patterns can be made at each position of needles, i.e., all the patterns on a row can be carried out in a single phase, which triples the productivity, while practically eliminating the time necessary to change the thread. In case of using more than 3 threads, the increase in productivity is proportional to the number of threads.

Moreover, for the manufacture of drawn thread embroidery, each embroidery position is provided with a punch which, according to a preestablished program will be engaged at desired locations.

Consequently, it is no longer necessary to stop the machine to remove or add punches, as is the case for the machines of the prior art.

The sewing heads according to the invention can be mounted in both embroidery machines with a vertical working plane and embroidery machines with a horizontal working plane, these machines can be either of the shuttle or hook type.

These sewing heads can also be adapted to industrial, handicraft or household sewing machines.

I claim:

1. A sewing head for an embroidery machine comprising a cradle mounted on said embroidery machine;

a cylindrical sector mounted to rotate about an axis within said cradle;

a plurality of needle holder bars carried by said cylindrical sector with each having its longitudinal axis arranged parallel both to the axis of the cylindrical sector and to one another for movement therealong;

a push rod operatively connected to said sector for rotating said cylindrical sector within said cradle to selectively locate only one of said plurality of needle holder bars in an operating position; and a drive arm actuated by the mechanisms of said embroidery machine for engaging and reciprocally moving said one needle holder bar when in its selective operative position;

whereby said one needle holder bar member is operatively connected to the mechanism of said embroidery machine.

2. A sewing head as claimed in claim 1 including a punch holder bar located parallel to said needle holder bars in said cradle, and a second drive mechanism for moving said punch holder bar reciprocally with said needle holder bar.

3. A sewing head as claimed in claim 1 wherein said cradle is pivotally mounted on the embroidery machine whereby said sewing head can be moved between an operative position and an inoperative position relative to the drive mechanisms of the embroidery machine.

4. A sewing head as claimed in claim 1 wherein said push rod includes a gear toothed portioned located thereon, and said cylindrical sector includes a plurality of gear teeth located on the periphery thereof adapted to mesh with said teeth of said push rod whereby said cylindrical sector can be rotated in response to the movement of said push rod.

5. A sewing head as claimed in claim wherein each of said needle holder bars includes a projection extending transverse to the longitudinal axis of said bar; and a longitudinal groove located in the periphery of said cylindrical sector for slidably accepting said projection on each of said needle holder bars; whereby each of said needle bars is movable axially within said cylindrical sector.

6. A sewing head as claimed in claim wherein each of said needle holder bars includes a projection that extends transverse to the longitudinal axis of said bar; said drive arm engages said projection of that one needle holder bar operatively selected to be coupled to the embroidery mechanism.

7. A sewing head as claimed in claim 1 wherein a second longitudinal groove is located in said cylindrical sector adapted to accept the opposite end of each of said projections on said needle holder bars whereby each of said bars is slidably supported on opposite sides within said cylindrical sector.

8. A sewing head as claimed in claim 2 wherein the second drive mechanism reciprocally moves said punch holder upon selectively moving said push rod to an operative engaging position.

9. A sewing head as claimed in claim 8 wherein a preselected position of said push rod disengages said needle holder bars from their operative position.

* * * * *